US006767078B2

(12) United States Patent
Sato et al.

(10) Patent No.: US 6,767,078 B2
(45) Date of Patent: Jul. 27, 2004

(54) INK JET HEAD HAVING A NOZZLE PLATE

(75) Inventors: Akira Sato, Yokohama (JP); Ichiro Tono, Yokohama (JP); Masato Sawada, Yokohama (JP); Hiroshi Nishimura, Yokohama (JP); Hideo Eto, Yokohama (JP); Makoto Saito, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/214,592

(22) Filed: Aug. 9, 2002

(65) Prior Publication Data

US 2003/0030696 A1 Feb. 13, 2003

(30) Foreign Application Priority Data

Aug. 10, 2001 (JP) ..... 2001-244463
Apr. 17, 2002 (JP) ..... 2002-115215

(51) Int. Cl.[7] ..... B41J 2/14
(52) U.S. Cl. ..... 347/45
(58) Field of Search ..... 347/45, 47; 428/421

(56) References Cited

U.S. PATENT DOCUMENTS 4,343,013 A * 8/1982 Bader et al. ..... 347/45
5,208,606 A * 5/1993 Klein et al. ..... 347/45
5,365,255 A * 11/1994 Inoue et al. ..... 347/45
5,385,751 A * 1/1995 Riaz et al. ..... 427/126.2

FOREIGN PATENT DOCUMENTS

JP 5-338180 A * 12/1993 ..... B41J/2/135
JP 2001-179989 A * 7/2001 ..... B41J/2/135

OTHER PUBLICATIONS

Madou, Fundamentals of Microfabrication, 1997, CRC Press, pp. 105–113.*

Y. Yang, J. Bharathan, Ink–Jet Printing Technology and its Application in Polymer Mutlicolor EL Displays.*

* cited by examiner

*Primary Examiner*—Juanita Stephens
*Assistant Examiner*—Blaise Mouttet
(74) *Attorney, Agent, or Firm*—Oblon, Spivak, McClelland, Maier & Neustadt, P.C.

(57) ABSTRACT

An ink jet head includes a nozzle plate having a nozzle hole and a film having at least one of a water repellent function and an oil repellent function formed on one plate face thereof. The film includes a metal oxide and fluorine based resin.

5 Claims, 7 Drawing Sheets

INK JET HEAD HAVING A NOZZLE PLATE

CROSS-REFERENCE TO RELATED APPLICATIONS

This application is based upon and claims the benefit of priority from the prior Japanese Patent Applications No. 2001-244463, filed Aug. 10, 2001; and No. 2002-115215, filed Apr. 17, 2002, the entire contents of both of which are incorporated herein by reference.

BACKGROUND OF THE INVENTION

1. Field of the Invention

The present invention relates to an ink jet head manufacturing method and an ink jet head, the ink jet head having a nozzle plate which has a film having at least one of a water repellent function and an oil repellent function provided on a surface thereof. In addition, the present invention relates to an ink applying apparatus and an ink applying method for applying an organic electro luminescence positive hole transport solution and an organic electro luminescence solution by using this ink jet head. Further, the present invention relates to an organic electro luminescence display apparatus with its high luminescence and long service life using this ink applying apparatus and a method of manufacturing the same.

2. Description of the Related Art

A nozzle plate provided on an ink jet head to be used for an ink jet printer is formed of a material such as a metal, a stainless steel, a ceramics, or an organic film. A number of nozzle holes of several microns to 100 microns in diameter are regularly formed on this nozzle plate.

The above nozzle plate is provided so as to cover an ink chamber of the ink jet head, and the above ink chamber is pressurized due to deformation of an piezoelectric element or the like, for example, whereby the liquid in the ink chamber is ejected in a predetermined direction from the nozzle hole formed on the above nozzle plate.

If the liquid ejected from the ink chamber is adhered or remains at the periphery of the nozzle hole of the above nozzle plate, a liquid to be ejected next interferes with the liquid that remains at the above nozzle plate. Thus, its ejection direction or ejection quantity may change.

Because of this, a film (hereinafter, referred to as a "water repellent film") having a water repellent function or an oil repellent function, which is formed of a fluorine based resin such as a fluorine based polymeric film or a fluorine silicone film is provided on one plate face of a side on which the liquid of the above nozzle plate is ejected, whereby the liquid ejected from the nozzle hole is prevented from being adhered or remaining at the periphery of the nozzle hole.

A method of providing a water repellent and oil repellent film on a plate face of a nozzle plate can be roughly divided into a wet coating method such as a dip method, a spray method, or a transcription method (an offset printing method); and a dry coating method using a plasma CVD (chemical vapor deposition) method.

On the other hand, attention is paid to an organic electro luminescence element (hereinafter, referred to as an "organic EL") using a multi-layered film of an organic material (for example, Jpn. Pat. Appln. KOKAI Publication Nos. 63-264692, 63-295695, 1-243393, and 1-245087). There are two methods; a method of producing an organic EL element by vacuum evaporating a low molecule and a method of producing an organic EL element by applying a polymeric solution. In the method of applying a polymeric solution, an area can be easily increased. In particular, this method is suitable for a full color display with its high definition and large screen using an ink jet process.

A water repellent and oil repellent film is provided on a plate face of the above described nozzle plate by using either of these two methods. In any case, any of the following problems has occurred. First, on the nozzle plate, the water repellent and oil repellent film invades into the nozzle hole, and is adhered on its inner periphery face. Thus, the nozzle hole is clogged or the hole diameter is reduced, whereby the quantities of liquids ejected from a plurality of nozzles are not uniform, resulting in degradation of the liquid ejection performance.

In order to remove the water repellent and oil repellent film adhered or remaining on the inner periphery face of the nozzle hole, the respective holes have been drilled. However, a large amount of work is required to remove the water repellent and oil repellent film by using such a method, which is impractical.

Second, if a nozzle plate is made of an metal oxide such as a metal, a stainless steel and a ceramics, even if a fluorine based resin is provided on this plate, the quality of the plate is inferior in respects of reliability such as intimacy or durability.

In order to overcome this disadvantage, as disclosed in Jpn. Pat. Appln. KOKOKU Publication No. 5-5664, there is provided an ink jet head in which a water repellent and oil repellent film consisting of a fluorine polymer is provided on a hole face of a nozzle (a nozzle plate) made of a glass ceramics via an intermediate layer consisting of a silicon polymer by using a plasma CVD method.

The intermediate layer consisting of a silicon polymer is provided between the water repellent and oil repellent film and a nozzle hole face, thereby making it possible to improve intimacy between the water repellent and oil repellent film and the nozzle hole face to some extent.

However, a structure disclosed in this publication is a double-film structure in which the intermediate layer consisting of the silicon polymer and the water repellent and oil repellent film consisting of the fluorine polymer are sequentially formed to be layered with each other. Therefore, the rigidity of bonding faces of the intermediate layer and the water repellent and oil repellent film is not sufficiently obtained, which has not been sufficient in respect of reliability such as intimacy or durability.

On the other hand, when a polymeric solution has been applied by using the ink jet head, the following problem has occurred. That is, an ejection failure may occur while the solution is applied by ink jetting. In the case where such an ejection failure occurs with a display, a display failure may result, and requirements for products are not met. Thus, ejection stability or durability is required for this ink jet head.

BRIEF SUMMARY OF THE INVENTION

It is a first object of the present invention to provide an ink jet head manufacturing method and an ink jet head, the ink jet head having a nozzle plate such that a water repellent and oil repellent coil adhered to an inner periphery face of a nozzle hole can be removed reliably and easily.

It is a second object of the present invention to provide an ink jet head manufacturing method and an ink jet head such that bonding rigidity between a nozzle plate and a water repellent and oil repellent film can be sufficiently improved.

It is a third object of the present invention to provide: an ink applying apparatus and an ink applying method capable of applying an ink with high precision; and an organic EL display apparatus and a method of manufacturing the same in which an ink is applied with high stability and with high precision by using this ink applying apparatus.

In order to solve the above problem and achieve the above objects, the present invention is constituted as follows. A method of manufacturing an ink jet head having a nozzle plate which has a film having at least one of a water repellent function and an oil repellent function formed on one plate face thereof comprises a step of providing the film on one plate face of the nozzle plate; and a step of etching the nozzle plate from the other plate face side, thereby removing the film adhered onto the inner periphery face of the nozzle hole.

An ink jet head manufacturing method for forming a film having one of a water repellent function and an oil repellent function on one plate face of a nozzle plate having a nozzle hole, is characterized by comprising gradually decreasing a first raw material gas containing a metal oxide component and a second raw material gas containing a fluorine based resin component in rate of the first raw material gas from a state in which a rate of the first raw material gas is greater than that of the second raw material gas; and gradually increasing a rate of the raw material gas, thereby forming the film on one plate face of the nozzle plate in accordance with CVD.

The present invention is characterized in that an organic electro luminescence positive hole transport solution and an organic electro luminescence solution are applied by using the above described ink jet head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

Figure 1:
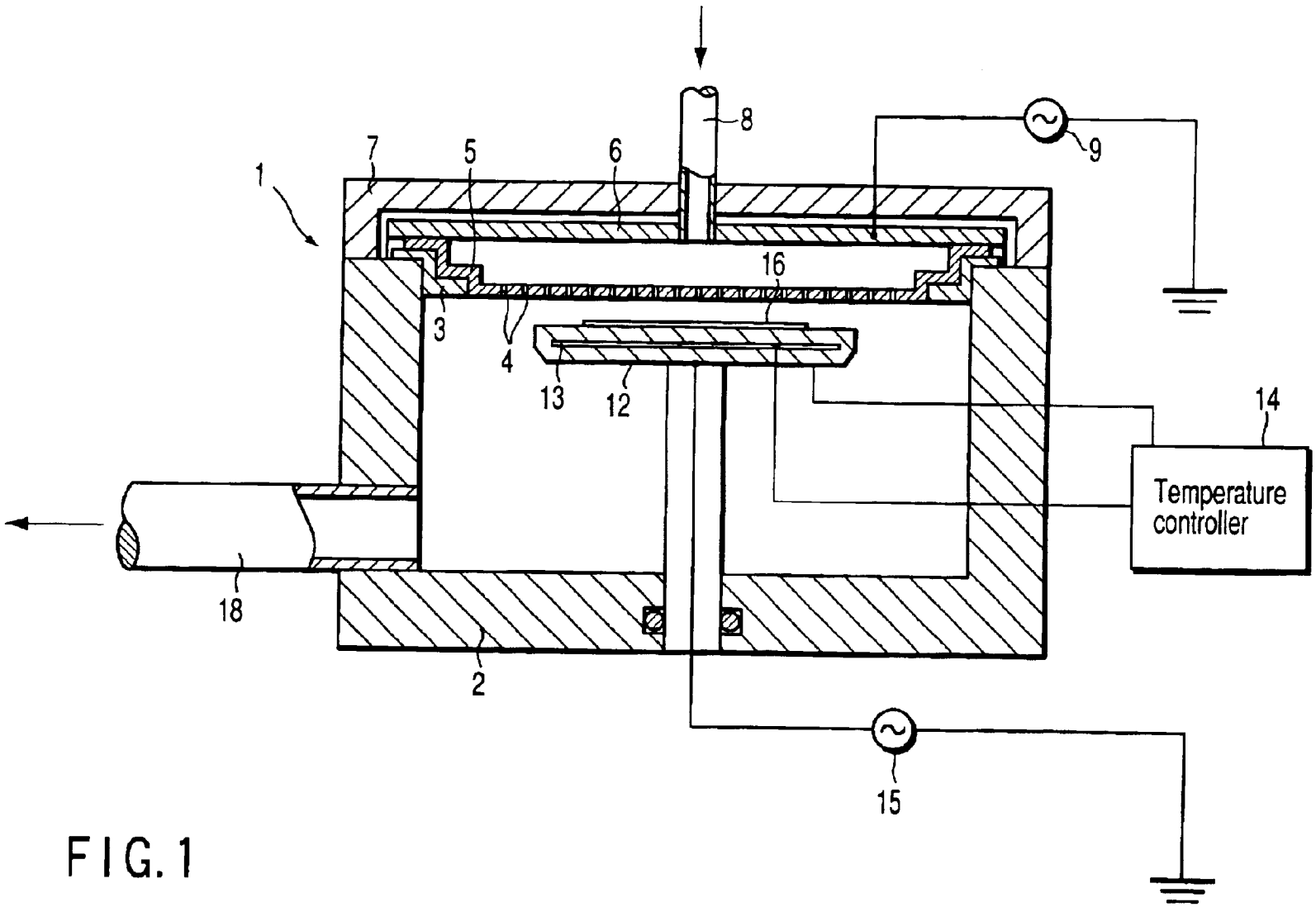
FIG. 1 is a schematic diagram showing a constitution of a plasma processing apparatus according to a first embodiment of the present invention.

Hereinafter, preferred embodiments of the present invention will be described with reference to the accompanying drawings. FIG. 1 to FIGS. 3A and 3B each show a first embodiment of the present invention. FIG. 1 is a schematic diagram showing a constitution of a plasma processing apparatus 1 for use in the present invention. This plasma processing apparatus 1 has a box shaped main body 2 with its opened upper face. A container shaped gas dispersing plate 5 having a number of small holes 4 punched thereon is held on the upper face opening of this main body 2 via a spacer 3. On the upper face of this gas dispersing face 5, a disk shaped upper electrode plate 6 is provided so that its periphery is bonded with the periphery of the above gas dispersing plate 5.

The above upper electrode plate 6 is covered with a cover body 7 having the upper face opening of the above main body 2 closed with air tightness. To this cover body 7, a supply pipe 8 for selectively supplying a CVD (chemical vapor deposition) raw material gas or etching gas to a space at the upper face side of the gas dispersing plate 5 is connected. On the above upper electrode plate 6, an upper high frequency power source 9 for supplying a high frequency power of 13.56 Mz is connected to this upper electrode plate 6.

In the above main body 2, a support shaft 11 is erected from the bottom part of this main body 2, and a susceptor 12 serving as a stage opposite to the above upper electrode plate 6 is provided on the upper end of this support shaft 11. A heater 13 is provided in this susceptor 12, and a temperature controller 14 is connected to this heater 13. This temperature controller 14 is designed so as to heat and control the above susceptor 12 at a predetermined temperature via the above heater 13.

A lower high frequency power source 15 is connected to the above susceptor 12. This lower high frequency power source 15 supplies a high frequency power of 13.56 Mz to the above susceptor 12. In this manner, the susceptor 12 acts as a lower electrode plate.

Figure 2A:
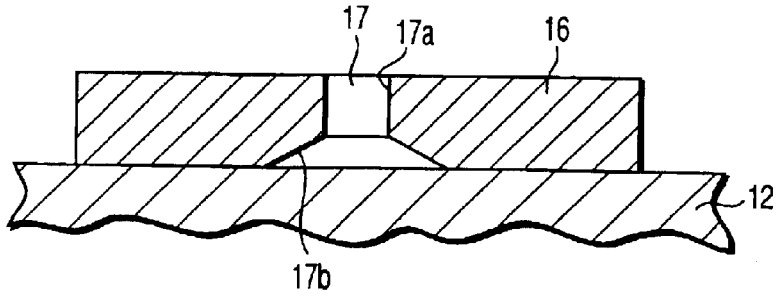
FIGS. 2A and 2B are illustrative views when a water repellent and oil repellent film is provided on one side face of a nozzle plate by using a plasma CVD method.

On the upper face of the susceptor 12, as shown in FIG. 2A, there is placed a nozzle plate 16 for an ink jet head, the plate being formed of a metal, a stainless steel, a ceramic, or an organic film in the shape of a band plate of about 0.4 mm in thickness. A number of nozzle holes 17 each having a circular hole portion 17*a* and a tapered portion 17*b* are regularly punched on this nozzle plate 16. The nozzle plate 16 is placed on this susceptor 12 while one side face having the circular hole portion 17*a* opened thereon is oriented upwardly, and the other side face is oriented to the above susceptor 12.

A high frequency power can be selectively supplied to the above upper high frequency power source 9 and the lower high frequency power source 15. Further, an air exhaust pipe 18 communicating with an air exhaust pump (not shown) is connected to the lower part of the main body 2. Through this air exhaust pipe 18, the pressure of the inside of the above main body 2 can be reduced to a predetermined pressure.

When a CVD raw material gas is supplied from the above supply pipe 8 to the inside of the main body 2 and a high frequency power of 13.56 Mz is supplied to the upper electrode plate 6 by means of the upper high frequency power source 9, a plasma is generated between the upper electrode plate 6 and the susceptor 12. Therefore, the raw material gas supplied from the above supply pipe 8 to the inside of the main body 2 is excited by such a plasma so that a predetermined component contained in the raw material gas can be precipitated on one side face (an upper face) of the nozzle plate 16 placed on the susceptor 12.

Namely, on one side face of the nozzle plate 16 placed on the susceptor 12, a film can be formed by using the CVD method. As a CVD raw material gas, there is used a fluorine based gas such as $CF_4$, $C_2F_6$, $C_4F_8$, or $C_5F_8$. In this manner, a water repellent and oil repellent film 20 (shown in FIG. 2B) consisting of a fluorine based polymeric film is formed on one side face of the susceptor 12.

On the other hand, when an oxygen gas serving as an etching gas is supplied from the above supply pipe 8 to the inside of the main body 2 and a high frequency power is supplied to the susceptor 12, an oxygen gas is excited by a plasma generated between this susceptor 12 and the above upper electrode plate 6. An oxygen ion existing in an oxygen plasma generated thereby is introduced into the susceptor 12, and thus, an etching action is subjected to the nozzle plate 16 placed on the susceptor 12, as described later.

Now, a procedure for forming the water repellent and repellent film 20 on the nozzle plate 16 by using the above constructed plasma processing apparatus 1 will be described here.

First, as shown in FIG. 2A, the nozzle plate 16 is placed on the susceptor 12 so that one side face having the circular hole portion 17*a* of the nozzle hole 17 opened thereon is oriented upwardly. Next, the CVD fluorine based raw material gas is supplied from the supply tube 8 and a high frequency power is supplied from the upper high frequency power source 9 to the upper electrode plate 6.

Figure 2B:
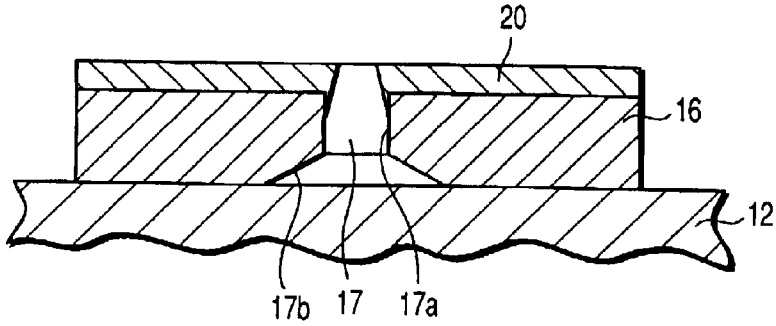

In this manner, on one side face of the above nozzle plate 16, the water repellent and oil repellent film 20 is formed by using the plasma CVD method, as shown in FIG. 2B. At this time, the water repellent and oil repellent film 20 is adhered to the inner periphery face of the nozzle hole 17, and thus, the shape of this nozzle hole 17 cannot be maintained in a normal shape.

Figure 3A:
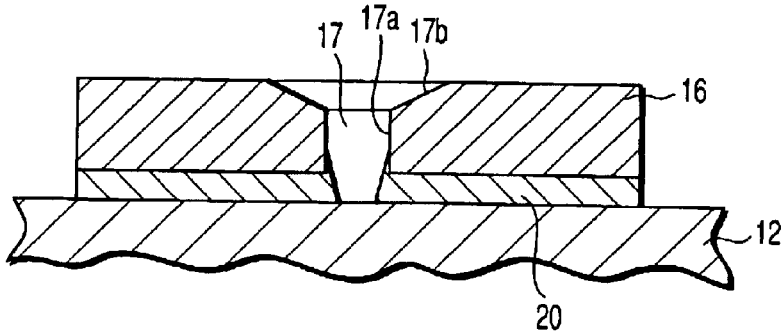
FIGS. 3A and 3B are illustrative views when a water repellent and oil repellent film adhered onto the inner periphery face of a nozzle hole is removed by plasma etching.

If the water repellent and oil repellent film 20 is formed on one side face of the nozzle plate 16, the nozzle plate 16 is placed on this susceptor 12 while one side face having the water repellent and oil repellent film 20 formed thereon is oriented to the susceptor 12 (downwardly) as shown in FIG. 3A.

Figure 3B:
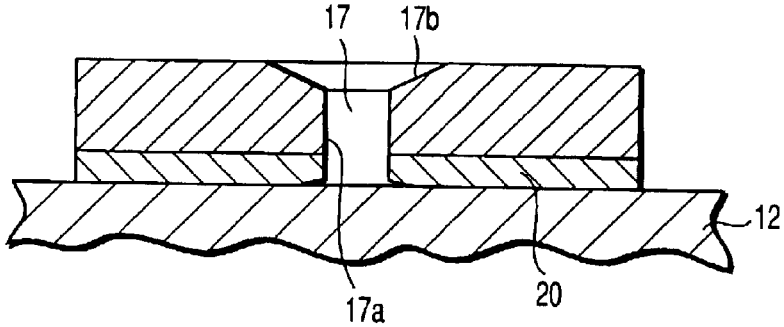

Next, an oxygen gas serving as an etching gas is supplied from the supply pipe 8 to the inside of the main body 2 and a high frequency power is supplied to the susceptor 12 by means of the lower high frequency power source 15. In this manner, the oxygen gas supplied to the inside of the main body 2 is produced as a plasma. Thus, due to the etching action of the oxygen ion contained in such a plasma, the water repellent and oil repellent film 20 adhered to the inner periphery face of the nozzle hole 17 as shown in FIG. 3A is removed as shown in FIG. 3B.

Namely, when the water repellent and oil repellent film 20 is formed on one side face of the nozzle plate 16 by using the plasma CVD method, the above water repellent and oil repellent film 20 is formed on the inner periphery face of the nozzle hole 17 as well, whereby the shape precision of the nozzle hole 17 cannot be maintained. However, after forming the water repellent and oil repellent film 20, the nozzle plate 16 is placed on the susceptor 12, and then, etched while its face is oriented downwardly, whereby the water repellent and oil repellent film 20 adhered to the inner periphery face of the nozzle hole 17 is removed, and the shape precision of this nozzle hole 17 can be ensured.

The shape precision of the nozzle hole 17 is ensured by means of etching, whereby a number of nozzle holes 17 formed on the nozzle plate 16 can be processed at the same time, thus making it possible to significantly improve workability or processing precision.

Figure 4:
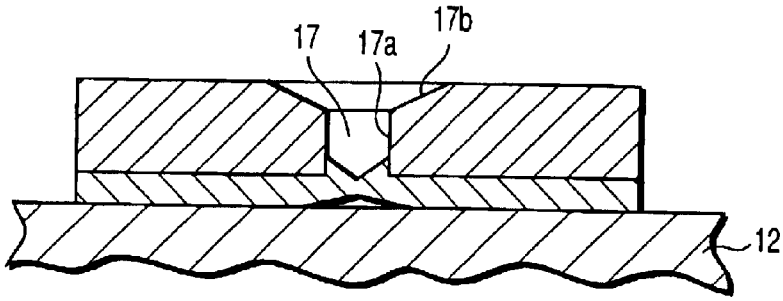
FIG. 4 is a sectional view showing a state in which a water repellent and oil repellent film according to a second embodiment of the present invention is provided on a nozzle plate by using a wet coating method.

FIG. 4 shows a second embodiment of the present invention, where the water repellent and oil repellent film 20 is provided on the nozzle plate 16 by using a wet coating method such as a dip technique, a spray technique, a transcription technique, or a spin coat technique. In this case, a quantity of inflow into the nozzle hole 17 of the water repellent and oil repellent film 20 is larger as compared with a case in which the film is provided by using the CVD method. Thus, the circular hole portion 17*a* of the nozzle hole 17 may be closed.

In the case where the water repellent and oil repellent film 20 is provided by using the wet coating method, if the water repellent and oil repellent film 20 is dried and solidified after coating, the nozzle plate 16 is placed on the susceptor 12 of the plasma processing apparatus 1. In this case, one side face having the water repellent and oil repellent film 20 provided thereon is placed opposite to the susceptor 12.

Then, as in the above first embodiment, an etching gas is supplied to the inside of the main body 2, and etching is carried out, whereby the water repellent and oil repellent film 20 in the nozzle hole 17 can be removed.

Namely, the water repellent and oil repellent film 20 adhered in the nozzle hole 17 is removed by etching, whereby the above water repellent and oil repellent film can be removed even by using the wet coating method without being limited to the dry coating method.

Figure 5:
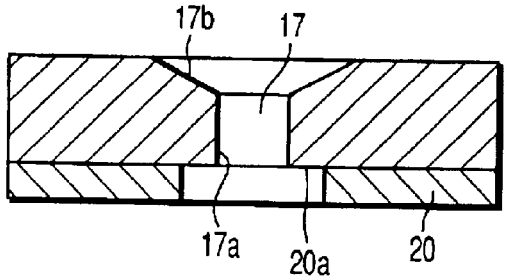
FIG. 5 is a sectional view of a nozzle plate illustrating an etching state of a water repellent and oil repellent film according to a third embodiment of the present invention.

FIG. 5 shows a third embodiment of the present invention. According to the present embodiment, as in the first and second embodiments, etching is further continued after removing the water repellent and oil repellent film 20 adhered to the inner periphery face of the nozzle hole 17. In this manner, there is formed a removal portion 20*a* from which the water repellent and oil repellent film 20 formed at the periphery of the circular hole portion 17*a* opened on one side face of the nozzle plate 16 is removed in a predetermined radius. Namely, a radical generated by producing an oxygen gas as a plasma is isotropic, and thus, the water repellent and oil repellent film 20 at the lower face of a nozzle plate, namely, at the periphery of the circular hole portion 17*a* as well is etched by such a radical.

When the water repellent and oil repellent film 20 at the periphery of the circular hole portion 17*a* is thus removed, thereby forming the removal portion 20*a*, the diameter of a liquid level at the lower end of the nozzle hole 17 during non-pressurization in an ink chamber (not shown) is increased to that of the removal portion 20*a* which is greater than that of the nozzle hole 17. Thus, the stability of such a liquid level is improved, and the splash direction of liquid droplets during pressurization can be stabilized.

Figure 6A:
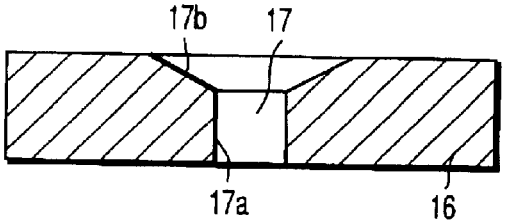
FIGS. 6A to 6C are illustrative views illustrating a procedure for ensuring the shape precision of a nozzle hole when the water repellent and oil repellent film is formed by using a wet coating method according to a fourth embodiment of the present invention.
Figure 6B:
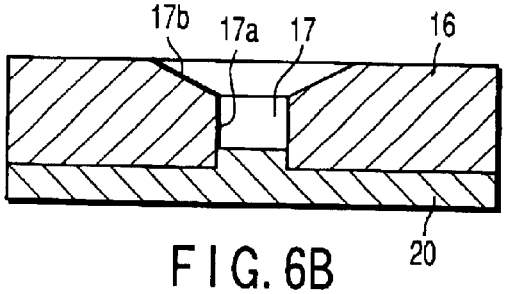
Figure 6C:
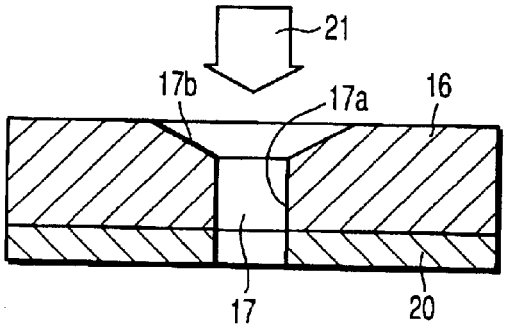

FIG. 6A to FIG. 6C each show a fourth embodiment of the present invention. According to the present embodiment, there is provided a method of maintaining the shape precision of a nozzle hole 17 when the water repellent and oil repellent film 20 has been formed by using the wet coating method. That is, FIG. 6A shows the nozzle plate 16, where the water repellent and oil repellent film 20 is formed on one side face of this nozzle plate 16 by using the wet coating method, as shown in FIG. 6B. In this manner, an end part at one side face of the nozzle hole 17 is closed by the water repellent and oil repellent film 20.

Now, before the water repellent and oil repellent film 20 formed by using the wet coating method is dried and solidified, a gas 21 such as air or nitrogen is blown from the other side face on which the water repellent and oil repellent film 20 is not formed, of the nozzle plate 16, as shown in FIG. 6C.

In this manner, the water repellent and oil repellent film 20 invaded into the nozzle hole 17 is removed due the pressure of the gas 21. Thus, the gas 21 is continuously flown until the water repellent and oil repellent film 20 has been dried and solidified, whereby the shape precision in which the water repellent and oil repellent film 20 is not protruded into the nozzle hole 17 can be ensured.

FIG. 7A to FIG. 7E each show a fifth embodiment of the present invention. According to the present invention, even when the water repellent and oil repellent film 20 has been formed in any of the wet coating method and dry coating method, the shape of the nozzle hole 17 can be maintained.

Figure 7A:
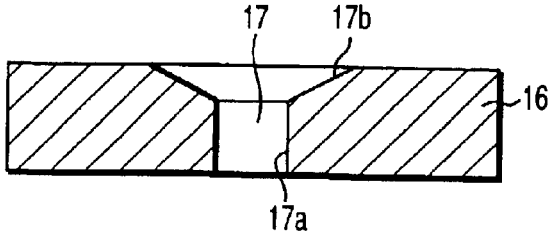
FIGS. 7A to 7E are illustrative views illustrating a method of forming a water repellent and oil repellent film according to a fifth embodiment of the present invention.
Figure 7B:
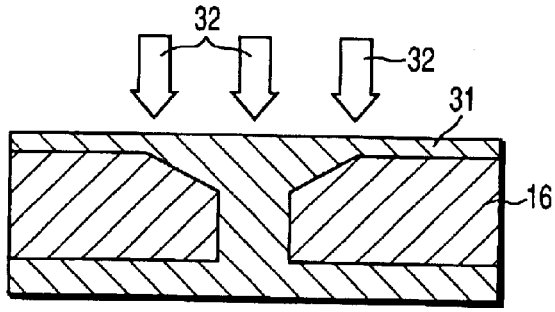

That is, FIG. 7A shows the nozzle plate 16. On this nozzle plate 16, as shown in FIG. 7B, a negative resist 31 hardened by ultraviolet rays is applied to at least one of one side face and the other side face (both side faces according to the present embodiment). At this time, the negative resist 31 is charged into the nozzle hole 17.

Next, as indicated by the arrow of FIG. 7B, ultraviolet rays 32 are emitted from the other side face side opposite to one side face on which the water repellent and oil repellent film 20 of the nozzle plate 16 is formed as described later. In this manner, the negative resist 31 is hardened at a portion covering the other side face of the nozzle plate 16 and a portion filled in the nozzle hole 17, and a portion covering one side face is not hardened.

Figure 7C:
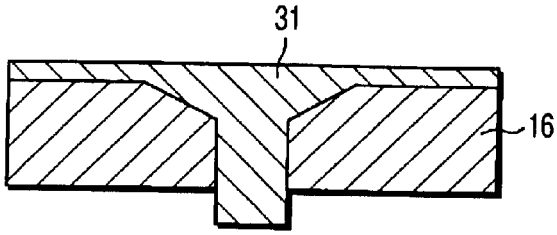

Next, as shown in FIG. 7C, a portion covering one side face of the nozzle plate 16 where the negative resist 31 is not hardened is fused and removed by a first solvent. At this time, the negative resist 31 remains while the resist is protruded from the nozzle hole 17 to one side face of the nozzle plate 16.

Figure 7D:
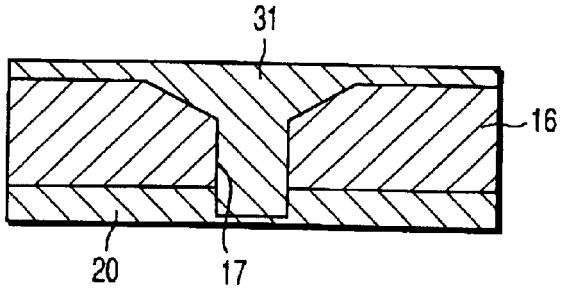

If the negative resist 31 on one side face of the nozzle plate 16 has been removed, the water repellent and oil repellent film 20 is formed on such one side face by using the wet coating method or the dry coating method, as shown in FIG. 7D.

Figure 7E:
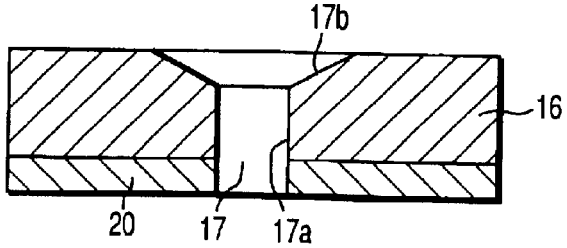

Next, as shown in FIG. 7E, the hardened negative resist 31 is fused and removed from the other side face of the nozzle plate 16 by using a second solvent. At this time, the water repellent and oil repellent film 20 adhered to an end face protruded from the nozzle hole 17 of the negative resist 31 is very thin, and thus, the film is removed (lifted off) together with the negative resist 31.

Therefore, even in such a method, it is possible to provide the water repellent and oil repellent film 20 on one side face of the nozzle plate 16 while the film is not adhered and remain on the inner periphery face of the nozzle hole 17.

Figure 8A:
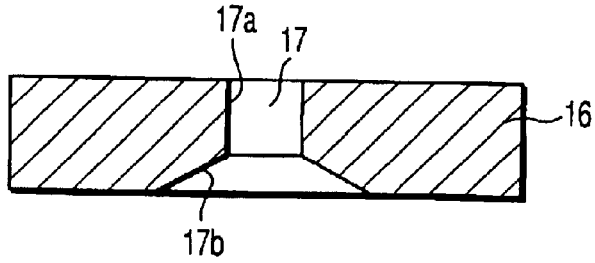
FIGS. 8A to 8E are illustrative views illustrating a method of forming a water repellent and oil repellent film according to a sixth embodiment of the present invention.
Figure 8B:
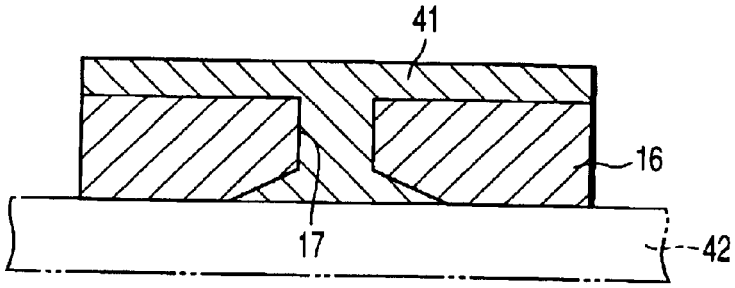

FIG. 8A to FIG. 8E each show a method of forming the water repellent and oil repellent film 20 according to a sixth embodiment of the present invention. FIG. 8A shows the nozzle plate 16 having the nozzle hole 17 formed thereon. On this nozzle plate 16, as shown in FIG. 6B, a resist 41 is applied to one side face having the water repellent and oil repellent film 20 formed thereon and the inside of the nozzle hole 17, as described later. At this time, the nozzle plate 16 is placed on a placement member 42, whereby the resist 41 is prevented from flowing the other side face of the nozzle plate 16 from the above nozzle hole 17.

Figure 8C:
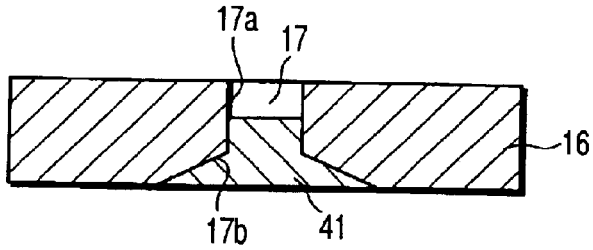

Next, as shown in FIG. 8C, there are removed a portion applied to one side face of the nozzle plate 16 of the above resist 41 and a portion filled in one side part of the circular hole portion 17*a* of the nozzle hole 17 with one end being opened on one side face thereof. Namely, the resist 41 is removed while leaving the tapered portion 17*b* of the nozzle hole 17 and a portion corresponding to the other end of the circular hole portion 17*a* which is continuous at this tapered portion 17*b*.

A method of removing a resist may be plasma etching capable of precisely setting a quantity of the remaining resist.

Figure 8D:
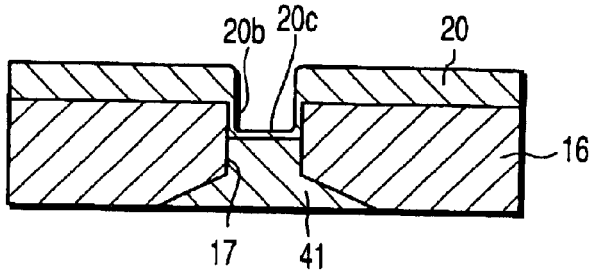

If the resist 41 is left partly on the inside of the nozzle hole 17, as shown in FIG. 8D, the water repellent and oil repellent film 20 is provided on one side face of the nozzle plate 16. In this manner, the water repellent and oil repellent film 20 enters the inside of the nozzle hole 17, and is adhered to an end face of the resist 41 that remains on the inner periphery face of the circular hole portion 17*a* and the inside of the nozzle hole 17.

Although means for providing the water repellent and oil repellent film 20 may be provided in accordance with the plasma CVD method using the plasma processing apparatus 1 shown in the first embodiment, such means may be provided in accordance with the wet coating method.

Figure 8E:
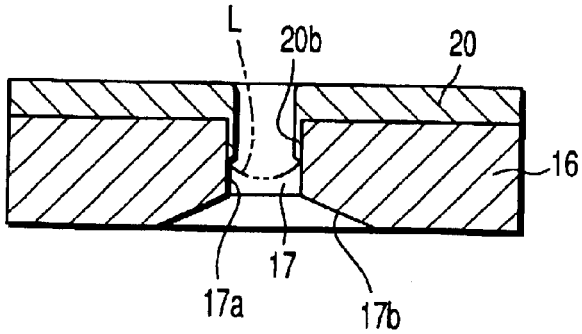

If the water repellent and oil repellent film 20 is thus provided, as shown in FIG. 8E, the resist 41 remaining in the nozzle hole 17 is removed. A method of removing the resist 41 may be either of a method of fusing and removing the resist by using a solvent and a method of removing the resist using plasma etching.

If the resist 41 is removed from the inside of the nozzle hole 17, a portion 20*b* adhered on the inner periphery face of one end part of the circular hole portion 17*a* of the nozzle hole 17, of the water repellent and oil repellent film 20 applied to the inside of the nozzle hole 17, remains intact. However, a portion 20*c* adhered to an end face of the resist 41 is removed together with this resist 41.

The water repellent and oil repellent film 20 is thus left on the inner periphery face at one end part of the circular hole portion 17*a* of the nozzle hole 17. In this manner, as indicated by the chain line of FIG. 8E, a level face L of a liquid ejected from the nozzle hole 17 is closed in the shape of a recessed face relevant to the ejection direction more inwardly than a portion 20*b* that remains on the inner periphery face of the nozzle hole 17 of the water repellent and oil repellent film 20 during non-pressurization of liquid.

Because of this, even if a waiting time is extended until the liquid droplets have been ejected from the nozzle hole 17, the liquid in the nozzle hole 17 is hardly dried.

In this case, it is possible to leave the water repellent and oil repellent film 20 on the inner periphery face of the nozzle hole 17 with uniform thickness. Thus, it is possible to prevent the ejection precision of liquid droplets from being lowered due to the lowered shape precision of the nozzle hole 17.

In the above embodiment, although a capacity coupling type plasma processing apparatus is used, it is possible to use another plasma processing apparatus such as an inductive coupling type plasma processing apparatus.

Figure 9:
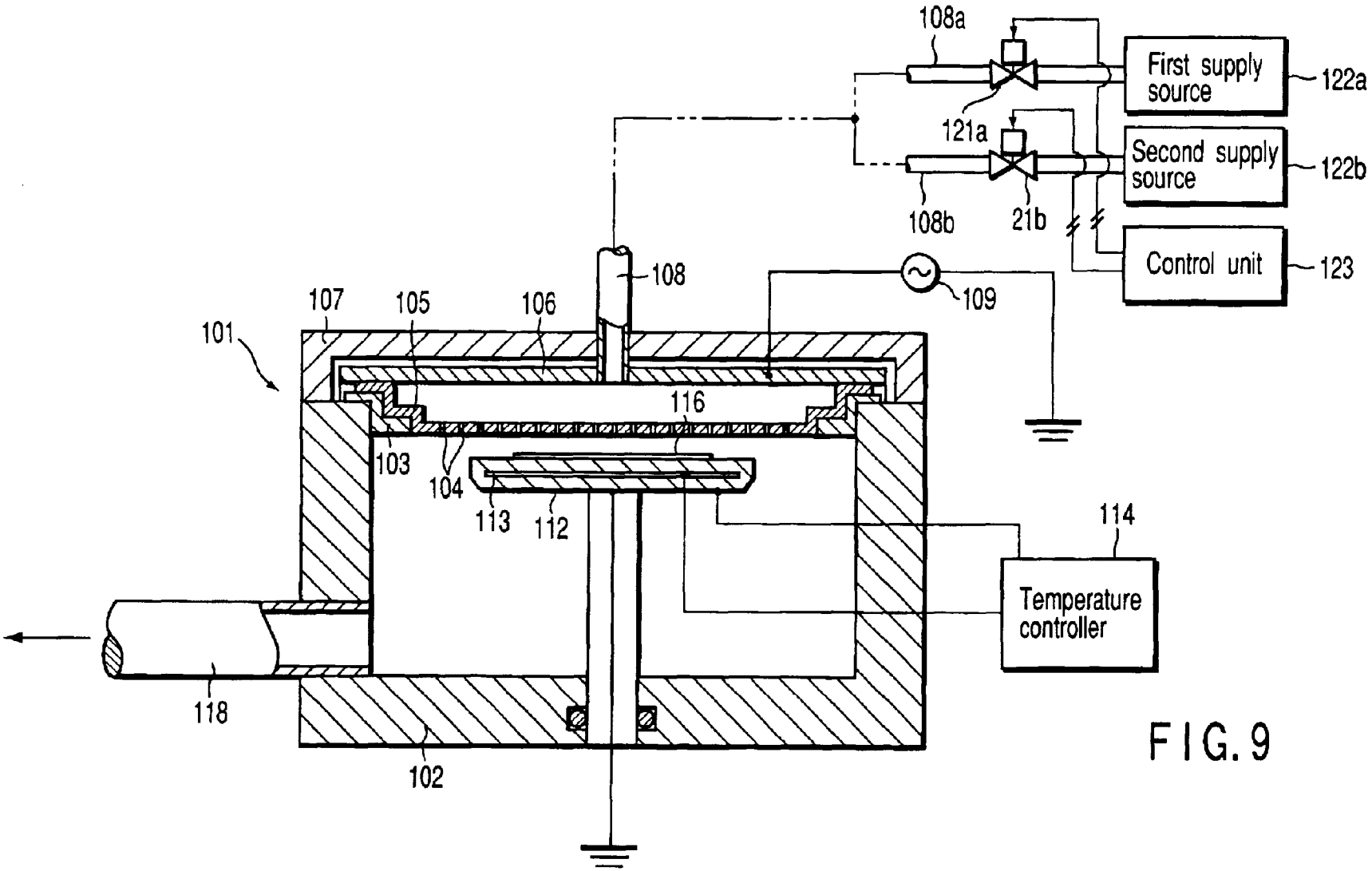
FIG. 9 is a schematic diagram showing a constitution of a plasma CVD apparatus according to a seventh embodiment of the present invention.
Figure 10:
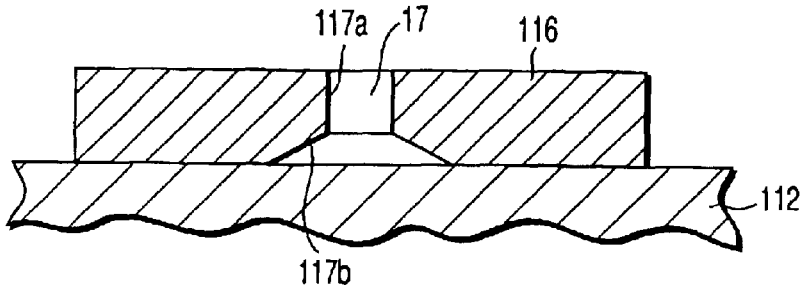
FIG. 10 is an illustrative view when a water repellent and oil repellent film is provided on one side face of a nozzle plate by using a plasma CVD method.
Figure 11:
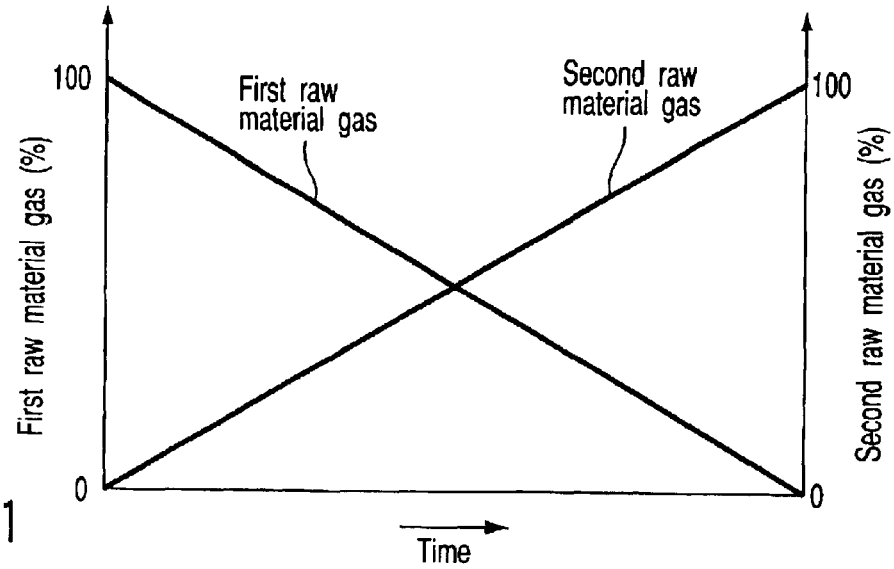
FIG. 11 is a view illustrating a supply rate between a first raw material gas and a second raw material gas.

FIG. 9 to FIG. 11 each show a seventh embodiment of the present invention. FIG. 9 is a schematic diagram showing a constitution of a plasma CVD apparatus 101 for use in the present invention. This plasma CVD apparatus 101 has a box shaped main body 102 with its opened upper face. A container shaped gas dispersing plate 5 having a number of small holes 104 punched thereon is held on the upper face opening of this main body 102 via a spacer 103. On the upper face of this gas dispersing plate 105, a disk shaped upper electrode plate 106 is provided to be bonded with the periphery of the above gas dispersing plate 105.

The above upper electrode plate 106 is covered with a cover body 107 having the upper face opening of the above main body 102 closed thereon with air tightness. To this cover body 107, one end of a supply pipe 108 for supplying a CVD raw material gas to a space on the upper face side of the above gas dispersing plate 105 is connected.

The other end side of the above supply pipe 108 is branched into two sections. A branch pipe 108*a*, one of these two sections, is connected to a first supply source 122*a* for supplying a first raw material gas via a first flow rate adjustment valve 121*a*. The other branch pipe 108*b* branched from the above supply pipe 108 is connected to a first supply source 122*b* for supplying a second raw material gas via a second flow rate adjustment valve 121*b*.

The above first flow rate adjustment valve 121*a* and second flow rate adjustment valve 121*b* are such that a degree of opening is controlled by a control unit 123. Therefore, the degree of opening between the first flow rate adjustment valve 121*a* and the second flow rate adjustment valve 121*b* is controlled, whereby a mixture rate between the first raw material gas and second raw material gas supplied into the above main body 102 can be arbitrarily controlled.

As the above first raw material gas, there is employed a gas containing a metal oxide component such as $Si(OR)_4$, $Zr(OR)_4$. As the second raw material gas, there is employed a gas containing a fluorine based resin component such as $C_2F_6$, $C_4F_8$, or $C_5F_8$.

On the above upper electrode plate 106, an upper high frequency power source 109 for supplying a high frequency power of 13.56 Mz is connected to this upper electrode plate 106.

In the above main body 102, a support shaft 111 is erected from the bottom part of this main body 102, and a susceptor 112 serving as a stage opposite to the above upper electrode plate 106 is provided at the upper end of this support shaft 111. A heater 113 is provided in this susceptor 112, and a temperature controller 114 is connected to this heater 113. This temperature controller 114 is designed so as to heat and control the above susceptor 112 via the above heater 113 at a predetermined temperature. The susceptor 112 is grounded.

On the upper face of the above susceptor 112, there is placed a nozzle plate 116 for an ink jet head formed of a metal, a stainless steel or a ceramics in the shape of a band plate of about 0.4 mm in thickness, that is a metal oxide, as shown in FIG. 10. A number of nozzle holes 117 each having a circular hole portion 117*a* and a tapered portion 117*b* are regularly punched on this nozzle plate 116. The nozzle plate 116 is placed on this susceptor 112 while one side face having the circular hole portion 117*a* opened thereon is oriented upwardly, and the other side face is oriented to the susceptor 112.

An air exhaust pipe 118 communicating with an air exhaust pump (not shown) is connected to the lower part of the above main body 102. Through this exhaust pipe 118, the pressure of the inside of the above main body 102 can be reduced to a predetermined pressure.

When the first raw material gas and second raw material gas for CVD are supplied from the above supply pipe 108 to the inside of the main body 102 at a predetermined rate and when a high frequency power of 13.56 Mz is supplied to the upper electrode pate 106 by means of the upper high frequency power source 109, a high frequency electric power discharge is generated with the upper electrode plate 106, and a plasma is generated by such a high frequency electric power discharge. Therefore, the first and second raw material gases supplied from the above supply tube 108 to the inside of the main body 102 are excited by such a plasma. In this manner, a predetermined component contained in these raw material gases precipitated on one side face (a top face) of the nozzle plate 116 placed on the above susceptor 112 so that a film can be formed.

Namely, on one side face of the nozzle plate 116 placed on the susceptor 112, the water repellent and oil repellent film 120 (shown in FIG. 10B) can be formed as described later in accordance with the plasma CVD method.

Now, a procedure for forming the water repellent and oil repellent film 120 on the nozzle plate 116 by using the above constructed plasma CVD apparatus 101 will be described here.

First, as shown in FIG. 10, the nozzle plate 116 is placed on the susceptor 112 so that one side face having the circular hole portion 117*a* of the nozzle hole 117 opened thereon is oriented upwardly. Next, a high frequency power is supplied from the upper high frequency power source 109 to the upper electrode plate 106 and a degree of opening between the first flow rate adjustment valve 121*a* and the second flow rate adjustment valve 121*b* is adjusted, whereby the first raw material gas and second raw material gas are supplied to the inside of the main body 102 while a mixture rate is changed with an elapse of time, as shown in FIG. 11.

That is, when this supplying starts, a rate of the first raw material gas containing an metal oxide component is set to 100%, and a rate of the second raw material gas containing a fluorine based resin component is set to 0%. With an elapse of time, the first raw material gas is gradually decreased, and a rate of the second raw material gas is gradually increased.

Figure 12:
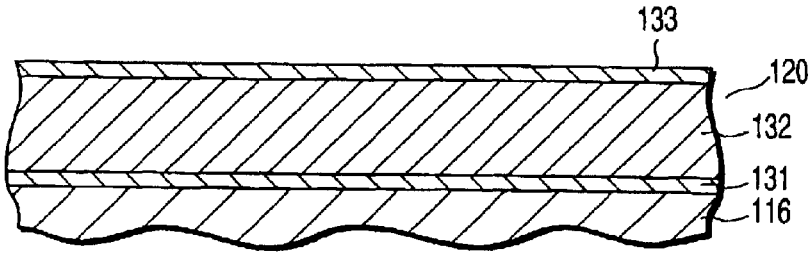
FIG. 12 is an enlarged sectional view illustrating a water repellent and oil repellent film.

In this manner, a thin metal oxide layer 131 is first formed on the nozzle plate 116, as shown in FIG. 12, and then, a mixture layer 132 having a metal oxide and a fluorine based resin mixed with each other is formed. In this mixture layer 132, the content of the metal oxide is more than that of the fluorine based resin, the content of the metal oxide gradually decreases, and the rate of the fluorine resin increases. Finally, a fluorine based resin layer 133 containing the metal oxide of 0% and the fluorine based resin of 100% is thinly formed, and the forming of the water repellent and oil repellent film 120 in accordance with the plasma CVD method terminates.

The water repellent and oil repellent film 120 thus constituted is formed on the nozzle plate 116, whereby a mixture layer 132 with its high mixture rate between a metal oxide film 131 first formed on the nozzle plate 116 and a metal oxide formed next is high in intimacy with the nozzle plate 116, and the mixture layer 132 with its mixture rate of the fluorine based resin formed at a final stage and the fluorine resin layer 133 formed next provide their high water and oil repellent functions as the water repellent and oil repellent film 120.

Further, the mixture layer 132 of the metal oxide and fluorine based resin formed between the metal oxide layer 131 and fluorine based resin layer 133 prevent the water repellent and oil repellent film 120 from separating from an intermediate section in its thickness direction, thereby improving durability (film intensity) of the entire water repellent and oil repellent film 120.

Namely, the mixture ratio between the metal oxide and fluorine based resin in the water repellent and oil repellent film 120 is continuously changed along the thickness direction of the above water repellent and oil repellent film 120. Moreover, the water repellent and oil repellent film 120 is continuously formed over the entire thickness direction without separating the metal oxide film 131 and the fluorine based resin layer 133. Thus, the water repellent and oil repellent film 120 with its excellent durability and reliability can be obtained as compared with a conventional film on which a plurality of layers are molded separately.

In FIG. 12, although the metal oxide layer 131, mixture layer 132, and fluorine based resin layer 133 are divided for clarity, these layers each continuously change in actuality, and the intervals between these layers are not partitioned.

A time of supplying only the second raw material gas is adjusted at an initial stage, whereby the thickness of the metal oxide layer 131 formed on the nozzle plate 116 can be changed. Similarly, a time of supplying only the first raw material gas is adjusted at a final stage, whereby the thickness of the fluorine based resin layer 133 can be changed.

In the above seventh embodiment, the mixture rate between the first raw material gas and second raw material gas is sequentially changed with an elapse of time. However, according to an eighth embodiment of the invention, the first raw material gas and second raw material gas are mixed at a rate of 1:1, whereby these gases may be supplied to the main body 102.

Figure 13:
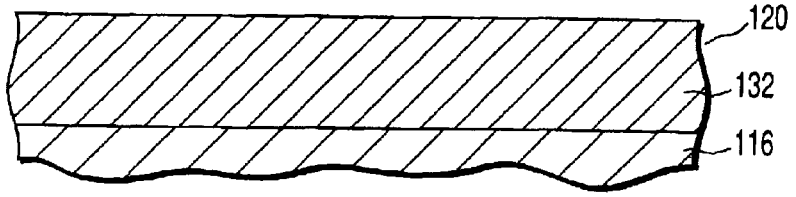
FIG. 13 is an enlarged sectional view illustrating a water repellent and oil repellent film according to an eighth embodiment of the present invention.

In this manner, on the nozzle plate 116, the water repellent and oil repellent film 120 consisting of the mixture layer 132 having the metal oxide and fluorine based resin mixed with each other therein is formed over the entire thickness direction, as shown in FIG. 13. In the mixture layer 132, the metal oxide contained therein improves intimacy with the nozzle plate 116 and its bonding intensity, and the fluorine based resin improves its friction resistance or water repellent and oil repellent functions. Thus, the water repellent and oil repellent film 120 with its excellent reliability can be obtained.

In this eighth embodiment, the mixture ratio between the first raw material gas and second raw material gas may be mixed at a different rate without being limited to 1:1. For example, when an attempt is made to improve intimacy between the water repellent and oil repellent film 120 and the nozzle plate 116 and bonding intensity, the rate of the first raw material gas may be increased. Further, when an attempt is made to improve the water repellent and oil repellent functions and friction resistance, the rate of the second raw material gas may be increased.

According to a ninth embodiment of the present invention, the first raw material gas is first supplied for a predetermined time, and then, the first and second raw material gases are supplied to be mixed at a predetermined rate, for example, 1:1. Thereafter, only the second raw material gas is supplied, whereby the water repellent and oil repellent film 120 may be formed.

Figure 14:
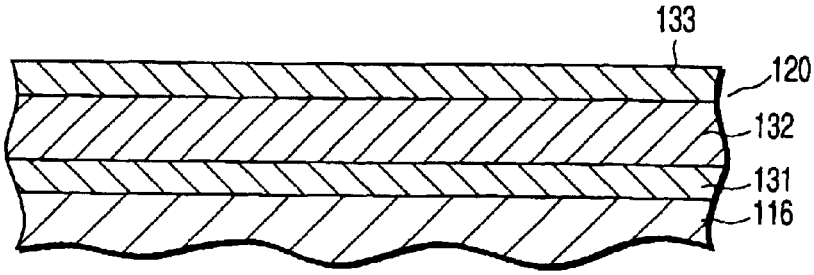
FIG. 14 is an enlarged sectional view illustrating a water repellent and oil repellent film according to a ninth embodiment of the present invention.

On the thus formed water repellent and oil repellent film 120, as shown in FIG. 14, the metal oxide film 131 is first formed on the nozzle plate 116, and then, the mixture layer 132 having metal oxide and fluorine based resin mixed with each other at a predetermined rate is formed. Then, the fluorine based resin layer 133 is formed.

According to this water repellent and oil repellent film 120 of the ninth embodiment, as in the water repellent and oil repellent film 120 of the seventh embodiment, the metal oxide layer 131, mixture layer 132, and fluorine based resin layer 133 does not change continuously, and are formed to be layered.

However, the mixture layer 12 is interposed between the metal oxide layer 131 and the fluorine based resin layer 133, where the metal oxide layer 131 and the fluorine based resin layer 133 are rigidly bonded integrally with each other by this mixture layer 132.

Therefore, even in the thus formed water repellent and oil repellent film 120, its sufficient durability and intimacy can be obtained.

In the respective present embodiments, although plasma CVD has been exemplified as means for forming a film on a nozzle plate, another film forming means may be provided, for example, by using thermal CVD.

Figure 15:
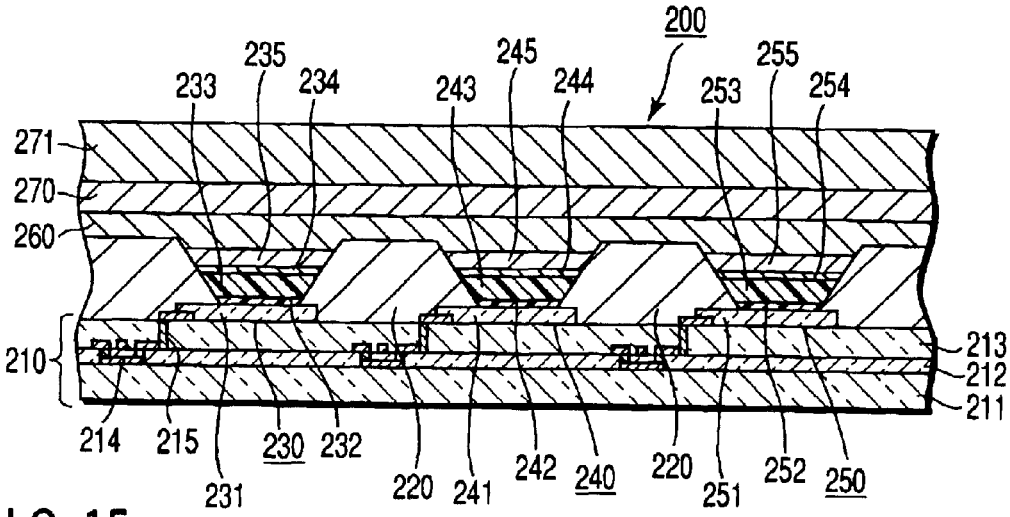
FIG. 15 is a sectional view showing essential portions of an organic EL display apparatus according to a tenth embodiment of the present invention.
Figure 16:
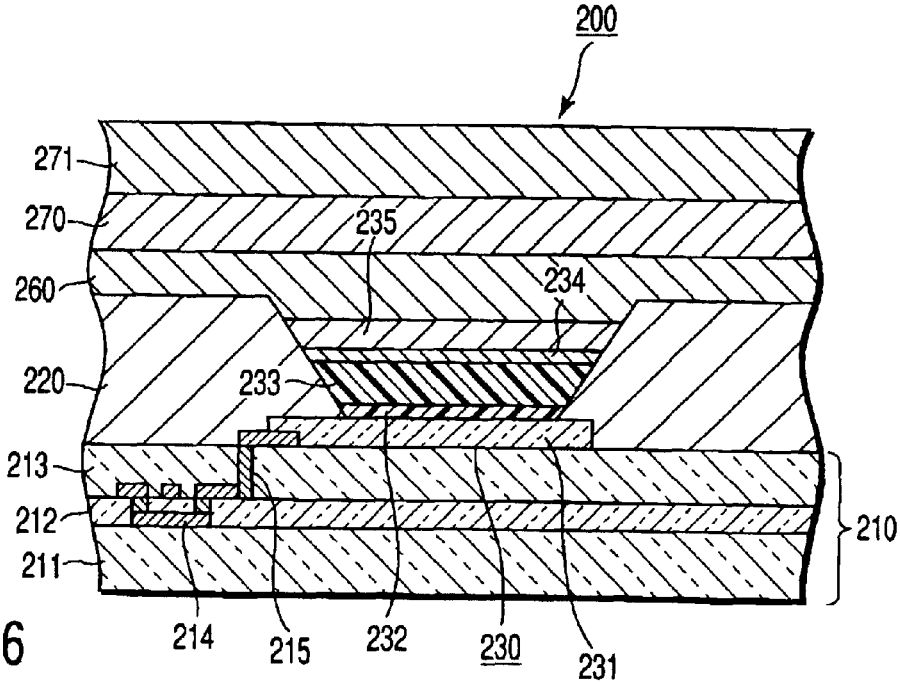
FIG. 16 is an enlarged sectional view showing an organic EL element and its periphery incorporated in the same organic EL display apparatus.

FIG. 15 is a sectional view showing essential portions of an organic EL display apparatus 200 according to a tenth embodiment of the present invention. FIG. 16 is an enlarged sectional view showing an organic EL element 230 and its periphery incorporated in the organic EL display apparatus 200. The organic EL display apparatus 200 comprises a transparent substrate 210 having insulation properties such as glass. A partition wall 220 consisting of an insulating material, the partition wall forming a cell, is formed on the surface of the transparent substrate 210. Organic EL elements 230 to 250 are formed in respective cells separated by the partition wall 220. This display apparatus further comprises a sealing film 260 for sealing a cell between the film and the partition wall 220 and a glass substrate 270 for covering this sealing film 260.

Three substrates 211 to 213 are laminated on the transparent substrate 210, and a transistor 214 and a wire 215 are internally formed. Further, the above described organic EL elements 230 to 250 are connected to the transistor 214, respectively.

At the organic EL element 230, there are sequentially formed: a transparent electrode (for example, anode) 231 such as ITO (indium-tin-oxide) which has electric conductivity and which is transparent; a positive hole transparent layer 232; a polymeric light emitting layer 233 which is an organic EL layer; a buffer layer 234; and an opposite electrode (for example, cathode) 235. At the organic EL element 240, there are sequentially formed: a transparent electrode 241; a positive hole transport layer 242; a polymeric light emitting layer 243, a buffer later 244; and an opposite electrode 245. At the organic EL element 250, there are sequentially formed: a transparent electrode 251 such as ITO; a positive hole transport layer 252; a polymeric light emitting layer 253; a buffer layer 254; and an opposite electrode 255.

The polymeric light emitting layer 233 is made of a material indicating light emission of red (R) as a pigment molecule for a light emitting center. The polymeric light emitting layer 243 is made of a material indicating light emission of green (G) as a pigment molecule for a light emitting center. The polymeric light emitting layer 253 is made of a material indicating light emission of blue (B) as a pigment molecule for a light emitting center. That is, one pixel is formed of three organic EL elements 230 to 250.

By using the transistor 214, a voltage is properly supplied between the transparent electrode and opposite electrode of any of the organic EL elements 230 to 250, whereby a desired color light is emitted from the polymeric light emitting layers 233, 243, and 253. That is, positive holes supplied from the transparent electrodes 231, 241, and 251 reach the polymeric light emitting layers 233, 243, and 253 through the positive hole transparent layers 232, 242, and 252. Electrons supplied from the opposite electrodes 235, 245, and 255 reaches the polymeric light emitting layers 233, 243, and 253 through the buffer layers 234, 244, and 254. As a result, the positive holes and electrons are coupled again with each other in the polymeric light emitting layers 233, 243, and 253, whereby light emission is obtained, making it possible to observe this desired color from the transparent substrate 210. Such a pixel is arranged in a two-dimensional manner, whereby an organic EL display apparatus can be configured.

The thickness of the positive hole transport layers 232, 242, and 252 each is about 2 nm to 100 nm, and more preferably, is 10 nm to 50 nm. If the thickness of the positive hole transport layers 232, 242, and 252 each is smaller than 2 nm, a film with its uniform thickness cannot be obtained. Further, the thickness is greater than 100 nm, absorption occurs with visible light, and the driving voltage is slightly increased.

It is desirable that the thickness of the polymeric light emitting layers 233, 243, and 253 each be about 10 nm to 200 nm. If the thickness of the polymeric light emitting layer 233, 243, and 253 each is greater than 200 nm, the driving voltage must be increased. In addition, the implanted electrons or positive hole is deactivated, the re-coupling probability is lowered, and the light emission efficiency of the polymeric light emitting layers 233, 243, and 253 each is lowered. If the thickness is smaller than 10 nm, a film with its uniform thickness is hardly obtained, and a deviation may occurs with light emitting properties for respective elements.

Now, a process of manufacturing an organic EL display apparatus 200 of 2.5 inches in area, for example, will be described here. Each pixel is arranged as shown in FIG. 16 so as to consist of monochrome organic EL elements 230 to 250, and the size of one pixel is manufactured so as to form 100 microns in area. FIG. 16 typically shows an organic EL element 230.

First, the transparent substrate 210 having insulation properties such as glass is manufactured by laminating the substrates 211 to 213. At this time, the transistor 214 and the wire 215 are provided. Next, the partition wall 220 is formed on the transparent substrate 210.

A glass substrate was used as the substrate 210, and an ITO being a transparent electrically conducting material was filmed in film thickness of 50 nm on the transparent electrodes 231, 241, and 251. A PEDOT ink (CH800) available from Bayer was used for the positive hole transport layers 232, 242, and 252. This material was subjected to surface processing so as to be 20 nm in film thickness, and then, was subjected to ink jet filming.

In addition, the positive hole transport layers 232, 242, and 252 were dried for 20 minutes by using an oven at 200° C. Further, by using an ink jet head subjected to each process thereon and by using an ink jet head on which the polymeric light emitting layers 233, 243, and 253 each were processed for pixels specified for colors R, G, and B each, a film was formed so as to be 200 nm in film thickness, and the formed film was dried for 1 hour by an oven at 100° C.

Then, a cell between the partition walls 200 is sealed with the sealing film 260, and further, the sealed cell is covered with the glass substrate 270, whereby the organic EL display apparatus 200 completes.

In the organic EL display apparatus 200 and the method of manufacturing the apparatus according to the tenth embodiment, even if a water repellent and oil repellent film is provided on a nozzle plate by using either of the wet coating method and dry coating method, it is possible to efficiently remove a water repellent and oil repellent film adhered on the inner periphery face of the nozzle hole. In particular, when a film is formed in accordance with dry coating, a film having a water repellent function or an oil repellent function has a mixture layer in which a metal oxide and a fluorine based resin are mixed with each other, thus making it possible to improve reliability such as intimacy or durability by using this mixture layer.

The present invention is not limited to the foregoing embodiments, and of course, various modification can occur without deviating from the spirit of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet head comprising:

a nozzle plate having a nozzle hole and a film having at least one of a water repellent function and an oil repellent function formed on one plate face thereof, wherein said film comprises a mixture of a metal oxide and fluorine based resin, and a percentage of the metal oxide of a mixture ratio of the mixture gradually decreases in a direction distant from a plate face of a nozzle plate in a thickness direction of said film.

2. An ink jet head comprising:

a nozzle plate having a nozzle hole and a film having at least one of a water repellent function and an oil repellent function formed on one plate face thereof, wherein said film comprises a mixture layer having a metal oxide and fluorine based resin mixed with each other.

3. An ink jet head comprising:

a nozzle plate having a nozzle hole and a film having at least one of a water repellent function and an oil repellent function formed on one plate face thereof, wherein said film is formed by sequentially continuously providing a metal oxide layer, a mixture layer having a metal oxide and fluorine based resin mixed with each other therein, and a fluorine based resin layer on a plate face of said nozzle plate by chemical vapor deposition.

4. An ink jet head comprising:

a nozzle plate having a nozzle hole and a film having at least one of a water repellent function and an oil repellent function partly formed on one plate face thereof, wherein the film comprises a metal oxide layer, a fluorine layer, and a mixture layer having a metal oxide and fluorine based resin mixed with each other.

5. The ink jet head according to claim 4, wherein the mixture layer is interposed between the metal oxide layer and the fluorine based resin layer.

* * * * *